US007378928B2

(12) United States Patent
Chang

(10) Patent No.: US 7,378,928 B2
(45) Date of Patent: May 27, 2008

(54) MAGNETIC PICK-UP TOOL

(76) Inventor: Wen-Lung Chang, 1564 Rollins Rd., Burlingame, CA (US) 94010

( * ) Notice: Subject to any disclaimer, the term of this patent is extended or adjusted under 35 U.S.C. 154(b) by 419 days.

(21) Appl. No.: 11/152,458

(22) Filed: Jun. 14, 2005

(65) Prior Publication Data

US 2006/0279390 A1 Dec. 14, 2006

(51) Int. Cl.
*H01F 7/20* (2006.01)

(52) U.S. Cl. ..... 335/285; 294/65.5

(58) Field of Classification Search ..... 335/285–289; 294/65.5

See application file for complete search history.

(56) References Cited

U.S. PATENT DOCUMENTS 3,223,898 A * 12/1965 Bey ..... 335/295
5,999,074 A * 12/1999 Coleman et al. ..... 335/285
6,048,073 A * 4/2000 Shiao ..... 362/120
6,677,845 B1 * 1/2004 Fader et al. ..... 335/285

* cited by examiner

*Primary Examiner*—Elvin Enad
*Assistant Examiner*—Bernard Rojas
(74) *Attorney, Agent, or Firm*—David E. Newhouse, Esq.

(57) ABSTRACT

A magnetic pick-up tool is described having a first, small diameter, high field strength permanent magnet pellet, permanently secured within a holder presenting a pole face at a distal tip of a probe extending from a handle, and at least a second, removable, small diameter, high field strength permanent magnet pellet stored, seated adhering in a receptacle located in the proximal end of the handle having a bottom composed of a high magnetically susceptible material.

11 Claims, 3 Drawing Sheets

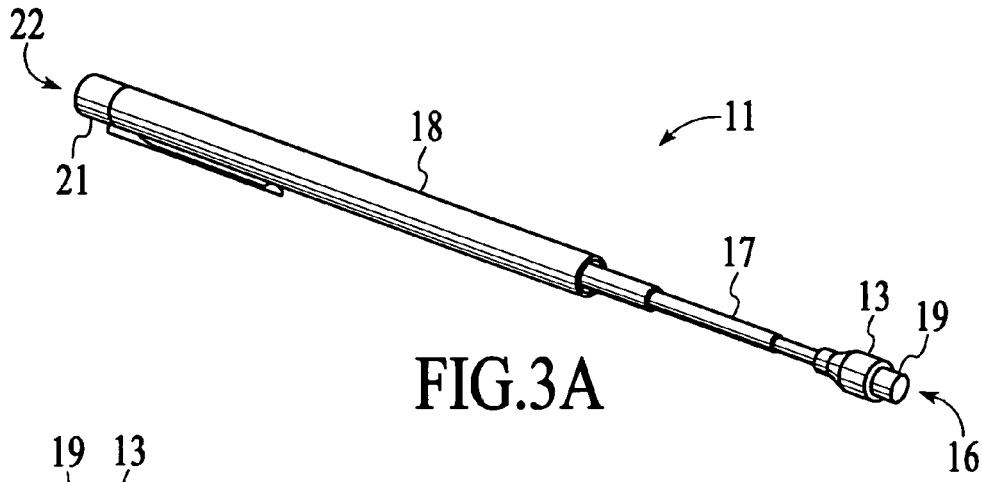
FIG.3A
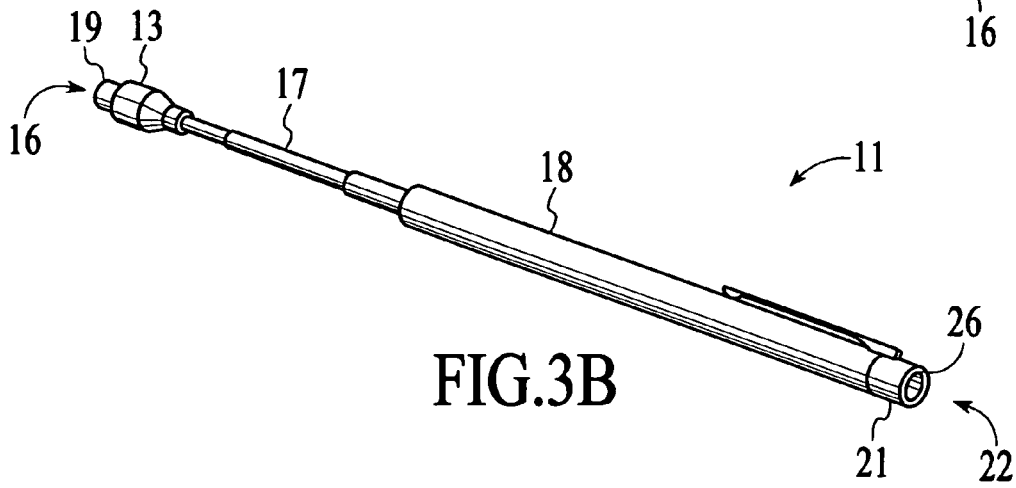
FIG.3B
FIG.4
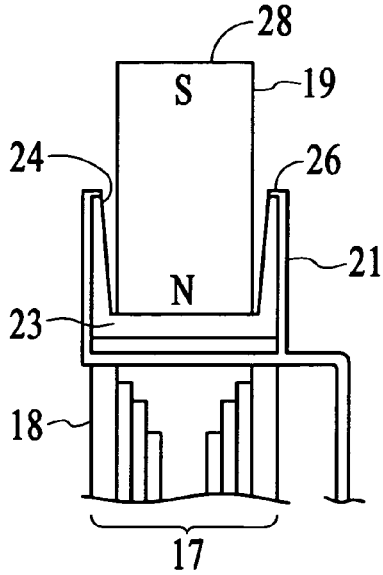

FIG.5
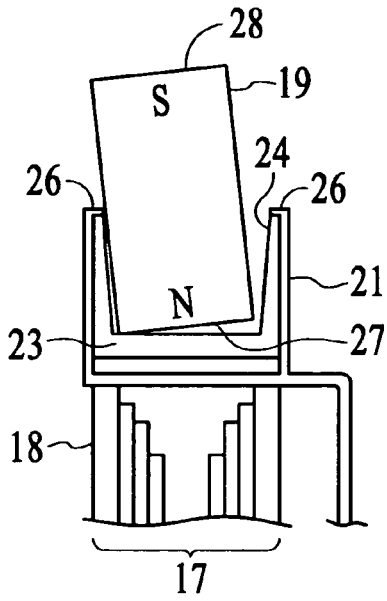
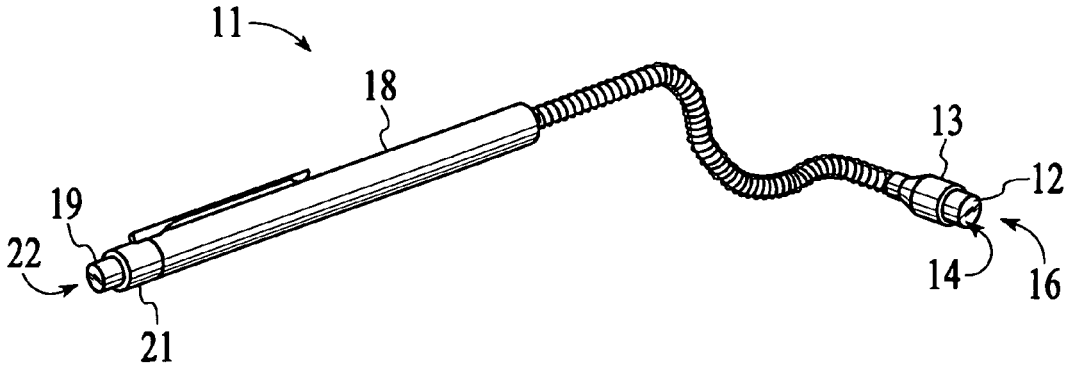
FIG.6

MAGNETIC PICK-UP TOOL

BACKGROUND OF THE INVENTION

1. Field of the Invention

The invention is a magnetic pick-up tool with at least a second, removable magnet seated in a handle receptacle that can be placed on the magnetic pick-up head for increasing the attractive magnetic field strength of the tool.

2. Description of the Prior Art

Magnetic pick-up tools are well known and widely used for retrieving dropped items such as nuts, bolts, screws, fasteners, tools and the like composed of magnetically susceptible materials from crannies inaccessible to hands and fingers. Such tools typically included a pick-up head presenting a pole face of a cylindrical bar magnet fastened by a holder at the end of an extensible (telescoping), bendable or flexible probe. (See U.S. Pat. No. 2,428,862 C. R. Boyd, U.S. Pat. No. 5,945,901 Coleman Jr. et al, & U.S. Pat. No. 6,677,845 Fader et al.) Typical holders are composed of a non-magnetically susceptible material, although, holders composed of magnetically susceptible materials have been found to increase the attractive or adhering magnetic force or field strength of the pick-up head pole face. (See U.S. Pat. No. 6,677,845 Fader et al.)

Some embodiments of magnetic pick-up tools feature translatable sleeves of magnetically susceptible materials disposed around the pick-up head for shielding or redirecting magnetic flux emanating between the poles of the magnet thus mitigating or reducing radial attractive forces along the length of the pick-up head. Such shielding enhances the utility of the tool in tight surroundings composed of magnetically susceptible structures. (See Coleman Jr. et al & Fader et al supra) In particular, without such shielding, the attractive magnetic forces of the pick-up head at the end of the probe cause it to adhere to the surrounding structures frustrating efforts to move it to pick up the dropped item.

Present rare earth, metal-based, permanent magnets such as Ne—Fe—B magnets provide high magnetic field strengths emanating from relatively small volumes. For example, a rare earth, metal-based, permanent magnet pellet 10 mm in diameter, and 5 mm in length in a 'larger' magnetic pick-up tool manufactured by CE Tools in Taiwan (Model No S5012-A) purportedly provides sufficient attractive force to retrieve dropped items weighing 3.5 lbs. (1.59 Kg.) A Gooseneck LED Light with Magnetic Pickup with a slightly larger, 'shielded' pick-up head marketed over the Internet at www.autosportcatalog.com by Auto Sport located in Charlottesville Va. boasts an attractive force capable of retrieving 5 lbs. (2.7 Kg.) articles. These larger diameter pick-up heads are limited both by size and magnetic field strength from probing into smaller crannies that all to frequently capture dropped items. While shielding (see Fader et al supra) can abate deleterious effects of magnetic field strength, it also increases pick-up head diameter.

Magnetic pick-up tools with smaller a rare earth, metal-based permanent magnet pellets having diameters less than 10 mm and 5 mm in length and lower magnetic field strengths, conversely are limited by those factors from retrieving larger (heavier) dropped items captured by lager crannies. In particular, the ratio of the surface areas of the pick-up magnet pole faces and available magnetic field do not provide sufficient adhering or attractive force to retrieve heavier items weighing in 3-5 lbs. (1.3-2.7 Kg.) range.

SUMMARY OF THE INVENTION

The invented magnetic pick-up tool includes a first, small diameter, high field strength permanent magnet pellet, permanently secured within a holder presenting a pole face at a distal tip of a probe extending from a handle, and at least a second, removable, small diameter, high field strength permanent magnet pellet stored, seated adhering in a receptacle located in the proximal end of the handle having a bottom composed of a high magnetically susceptible material.

The primary advantage of the invented magnetic tool is that it can retrieve small items dropped/captured in small crannies including those within/defined by highly magnetically susceptible structures, as well as larger heavier items in larger inaccessible crannies by the simple expedient of removing the second small diameter, high field strength permanent magnet pellet seated in the handle receptacle and placing it in an adhering relationship coaxially on the pole face of the first, small diameter, high field strength permanent magnet pellet, permanently secured within a holder at the probe tip to increased the attractive magnetic field strength of the tool enabling it to secure such larger heavier dropped items.

A novel aspect of the invented magnetic pick-up tool is that the holder securing the small diameter, high field strength permanent magnet pellet at the tip of the probe and the receptacle seating and storing the removable high field strength permanent magnet pellet both maybe composed of a magnetically susceptible material for redirecting magnetic flux emanating between the poles of the respective magnets effectively shielding them from strongly interacting with radially adjacent magnetically susceptible structures.

Another novel aspect of the invented magnetic pick-up tool is that handle receptacle receiving and storing the removable, high field strength, permanent magnet pellet may have flaring sidewalls to facilitate removal of the pellet from the receptacle.

Other aspects of the invented magnetic pick-up tool relate to acceptable ratios of handle receptacle depths ($R_d$) to removable magnet pellet lengths ($M_1$), and such factors as magnetic field strength, and degree of receptacle sidewall flare enabling a user to easily tip and remove the adhering magnetic pellet seated within the handle receptacle while still assuring secure storage of the removable magnetic pellet seated within the receptacle when not in use.

A particular advantage of the invented magnetic pick-up tool relates to a compact coaxial arrangement of its elements, i.e. the removable magnetic pellet seated within the handle receptacle at its proximal end, the handle, an extensible (telescoping) probe extending from the handle, the holder securing the high field strength, permanent magnet pellet at the distal tip of the probe are coaxial and aligned with the pole axes of the respective magnetic fields provided by the magnetic pellets.

BRIEF DESCRIPTION OF THE DRAWINGS

FIG. 3*a* & 3*b* presents a perspective view of the larger cranny, high magnetic field strength retrieval configuration of the invented magnetic pick-up tool.

FIG. 4 presents a cross-section view showing the relationship of the flaring handle receptacle walls and the removable, high field strength, permanent magnet pellet seated within the receptacle.

FIG. 5 illustrates the tipping of the removable, high field strength, permanent magnet pellet seated within the handle receptacle as it is being removed.

FIG. 6 presents a embodiment of the invented magnetic pick-up tool with a bendable goose neck probe.

DESCRIPTION OF PREFERRED AND EXEMPLARY EMBODIMENTS

Figure 1:
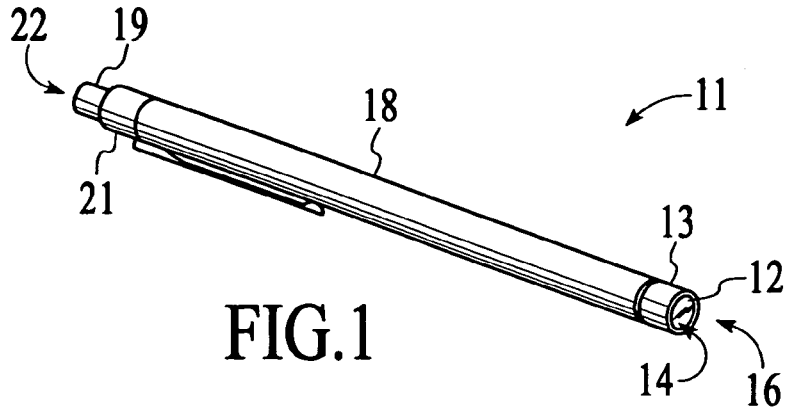
FIG. 1 presents a perspective view of the stored configuration of the invented magnetic pick-up tool.
Figure 2A:
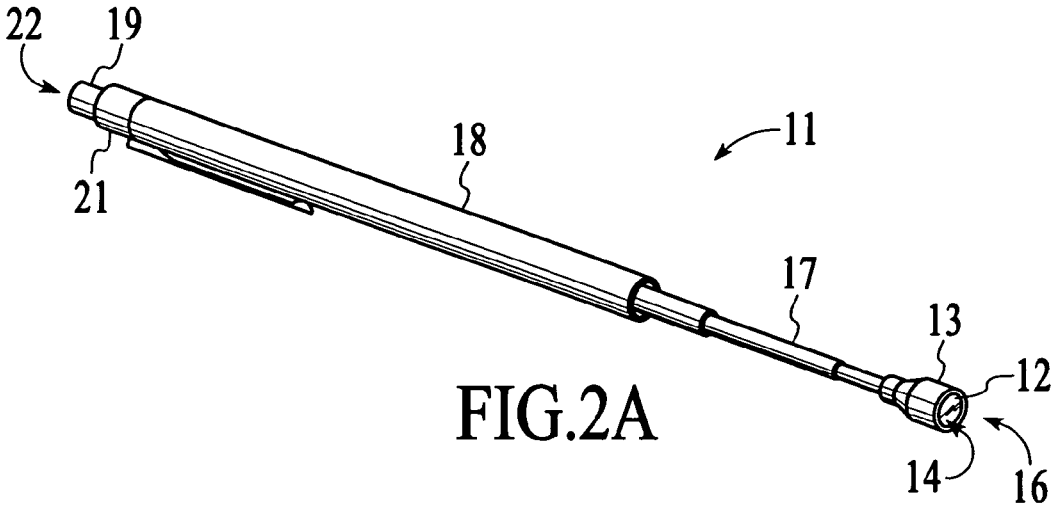
FIGS. 2*a* & 2*b* presents a perspective view of the small cranny, low magnetic field strength retrieval configuration of the invented magnetic pick-up tool.
Figure 2B:
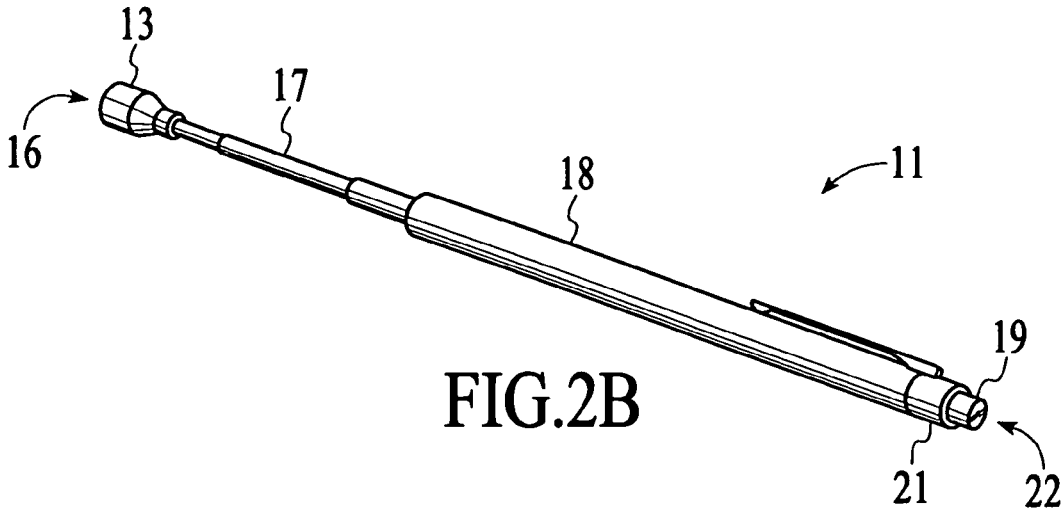

Looking at FIGS. 1, 2*a-b* & 3*a-b*, the invented magnetic pick-up tool 11 includes a high field strength, small diameter, permanent magnet pellet 12 permanently secured within a holder 13 presenting a magnet pole face 14 at a distal tip 16 of a extensible or telescoping probe 17 coaxially extending from and collapsing into a handle 18, A second, removable, small diameter, high field strength permanent magnet pellet 19 is stored, seated in a receptacle 21 coaxially located in the proximal end 22 of the tool handle 18. As shown in FIGS. 4 & 5, the bottom 23 of the receptacle 21 is composed of a high magnetically susceptible material to which a pole face of the removable magnet pellet 19 adheres.

With the invented magnetic pick-up tool, a user can probe into inaccessible nooks and crannies dimensionally permitting insertion of the holder 13 at the distal tip 16 of the probe 17. The strength of the magnetic field provided by the high field strength permanent magnet pellet 12 within the holder 13 at the probe tip 16, preferably, is not sufficient to cause the telescoping sections of the probe 17 to collapse into each other in the event a side of the holder comes into contact with structures defining or within the nook or cranny composed of magnetically susceptible materials. In other words, the radial component of the magnetic flux emanating between the respective magnetic poles is factor in choosing the magnet pellet 12 permanently mounted in the holder 13 at the tip 16 of the probe 17. Alternatively, the holder 13 may be composed of configurations of materials for reducing the radial component of the attractive magnet field of the magnet pellet 12 below a threshold that could cause the extensible probe to collapse in the event of side contact with a highly magnetically susceptible material.

In other instances when a larger and heavier object such a pipe wrench or other dropped tool or item is captured in a larger inaccessible nook or cranny, where the weight of the item is exceeds the attractive retrieval force of the permanently mounted magnet pellet 12 at the tip 16 of the probe 17, the user removes the removable small diameter, high field strength permanent magnet pellet 19 stored, seated in the receptacle 21 located in the proximal end 22 of the tool handle 18, and seats it with it's appropriate opposite polarity pole face adhering to the magnet pole face 14 of permanently mounted magnet pellet 12 within the holder. Seating of the opposite polarity pole face of the removable magnet pellet 19 on the pole face of the permanently mounted magnet pellet 12 increases the magnetic attractive force to enable the tool to pick-up and retrieve heavier dropped tools or items.

Preferably, the configuration of the removable magnetic pellet 19 and its opposite polarity pole face that seats of the pole face 14 of the permanent magnet pellet 12 is chosen for maximizing the adhering/attractive force between the adjacent opposite polarity pole faces of the magnet pellets. In fact, the magnetic field strength of the removable magnet pellet 19 may be greater than that of the permanently mounted magnet pellet 12. In particular, the radially component of the attractive magnetic field of the removable magnet pellet 19 stacked on the pole face 14 of the permanently mounted magnet 12 is not a limiting factor because of the larger dimensions of the nooks and crannies capturing larger items. In the embodiments of the invented magnetic pick-up tool illustrated in FIGS. 1, 2*a-b*, & 3*a-b*, both the permanently mounted magnet pellet 12 and the removable magnetic pellet 19 are cylindrical and have the same diameter.

Referring now to FIGS. 4 & 5, the sidewalls 24 of the receptacle 21 flare slightly outward conically from the receptacle bottom 23 to facilitate removal of the removable magnetic pellet 19 stored, seated within the receptacle 21. In particular, the bottom of the receptacle 23 preferably is composed of a highly magnetically susceptible material to maximize adherence of the removable magnet pellet 19 stored with a pole face seated on the receptacle bottom 23.

To remove a strongly magnetic adhering removable magnet pellet 19 from the receptacle 21, the user simply tips the seated pole face 26 of magnet pellet 19 away from the bottom 23 of the receptacle 21 essentially causing the magnetic attraction between the pole face 27 and receptacle bottom 23 to fail in peel, allowing the user to more easily grip, twist and pull the magnet pellet 19 from the receptacle.

In instances where it is desirable to reduce the attractive radial component of the magnetic field of the removable magnet pellet 19 seated in the handle receptacle 21, the flaring sidewalls 24 of the receptacle 21 may also be composed of a magnetically susceptible material for channeling the emanating magnetic flux between its respective poles. In such instance, the annular top 26 of the sidewalls 24 would function as annular pole face of a composite magnetic defined by the receptacle 21 and seated magnet pellet 19 stored within the receptacle thus, effectively minimizing the attractive radial component of the magnetic field.

Other factors, affecting removal of the removable magnet pellet 19 stored in the receptacle 21 relate the ratio of receptacle depth ($R_d$) and magnet pellet length or height ($M_1$). In particular the removable magnet pellet 19 should extend sufficiently above the sidewalls 24 of the receptacle as to enable a user to grasp the top end 28 of the pellet firmly between a thumb and forefinger first to tip the pellet and then to twist and pull the pellet from the receptacle overcoming the attractive magnetic attractive forces retaining the pellet in the receptacle. Yet, on the other hand, the height and flare of the sidewalls should not be such that the magnet pellet is likely to be dislodged out of the receptacle when the invented magnetic pick-up tool is dropped by the user, or when the user stores it with other tools and the exposed pole face of the removable magnet pellet 19 contacts and adheres to another tool having magnetic susceptibility. For cylindrical small, high field strength, permanent magnet pellets having diameters ranging between 5-7.5 mm and lengths ranging between 5-10 mm, depending on magnetic field strength, acceptable ratios of receptacle depth ($R_d$) to magnet pellet length ($M_1$), $R_d$:$M_1$ have been found to range between 1:5-3:5. Acceptable flare of the receptacle sidewalls 24 measured from the vertical has been found to range between 2° & 5°.

An alternative to flaring the receptacle sidewalls 24 is to make the diameter of the receptacle 21 slightly greater than diameter of the removable pellet 19 and to adjust the ratio of receptacle depth to magnet length $R_d$:$M_1$<0.50 so that a user can tilt the pellet out of the receptacle 21 using the top edge of the receptacle as a fulcrum with a degree of mechanical advantage.

FIG. 6 illustrates an embodiment the invented magnetic pick-up tool with a flexible/bendable 'gooseneck' probe 28 extending from the handle 18 of rather than linier extensible probe 17 that allows a user to shape the probe with the pick-up head 31 at its distal tip 16 and snake it around corners to retrieve inaccessible dropped items.

It should be appreciated that many modifications and variations of the essential elements of invented magnetic pick-up tool can be made both with respect to the particular tools described and other analogous tools which, while not described above, do fall within the spirit and scope of the invention as set forth in the appended claims.

I claim:

1. A magnetic pick-up tool comprising in combination, a first, small, high field strength, permanent magnet pellet, permanently secured within a holder presenting a pick-up pole face at a distal tip of a probe extending from a handle of the tool, and at least a second, removable, small, high field strength, permanent magnet pellet stored seated magnetically adhering in a receptacle within the handle of the tool having a bottom composed of a magnetically susceptible material, wherein the second magnetic pellet is removed by a user from the receptacle and placed coaxially adhering to the pick-up pole face of the first magnetic pellet for increasing the attractive magnetic field strength of the tool.

2. The magnetic pick-up tool of claim 1 wherein each receptacle receiving and seating a removable, small, high field strength, permanent magnet pellet has sidewalls flaring outward from its bottom allowing each removable magnet pellet to be tipped for removal from its particular receptacle.

3. The magnetic pick-up tool of claim 1 wherein the ratio of receptacle depth $R_d$, and length $M_1$ of each removable magnet received and seated in a receptacle ranges between 1:5 and 3:5.

4. The magnetic pick-up tool of claim 1 wherein the receptacle receiving and seating the second removable, small, high field strength, permanent magnet pellet coaxially penetrates into the proximal end of the handle with the second, removable magnet pellet seated within the receptacle with a planer pole face magnetically adhering to the magnetically susceptible bottom of the receptacle.

5. The magnetic pick-up tool of either claim 1, 2, 3, or 4 wherein the probe is extensible.

6. The magnetic pick-up tool of either claim 1, 2, 3, or 4 wherein the probe is flexible.

7. The magnetic pick-up tool of either claim 1, 2, 3, or 4 wherein the probe is bendable.

8. The magnetic pick-up tool of claim 5 wherein from its proximal end, the second, removable small diameter, high field strength, permanent magnet pellet stored, seated in the receptacle, the handle, the probe, and the first, small diameter, high field strength, permanent magnet pellet permanently secured within the holder at the distal tip of the probe are cylindrical and coaxial.

9. The magnetic pick-up tool of claim 8 wherein each removable magnet pellet has a diameter at least equal to the diameter of the first, small diameter, high field strength, permanent magnet pellet.

10. The magnetic pick-up tool of claim 8 wherein each removable magnet pellet has a diameter at most equal to the diameter of the first, small diameter, high field strength, permanent magnet pellet.

11. A method for increasing the attractive field strength of a magnetic pick-up tool having a handle and a pick-up head at a distal end of an extensible/flexible probe presenting a pole face of a first high strength permanent magnet, the steps comprising, a) making a handle receptacle in a proximal end of the tool handle;

b) securing a magnetically susceptible material at the bottom of the handle receptacle;

c) storing a second high strength permanent magnet pellet seated within the handle receptacle;

d) removing the second high strength permanent magnet pellet seated from the handle receptacle, and seating it with a pole face of opposite polarity magnetically adhering to the pole face of the of the first high strength permanent magnet presented by the pick-up head.

* * * * *